US006220163B1

(12) United States Patent
Duguet et al.

(10) Patent No.: US 6,220,163 B1
(45) Date of Patent: Apr. 24, 2001

(54) ELECTRO-PYROTECHNIC INITIATION SYSTEM PROTECTED AGAINST ELECTROSTATIC DISCHARGES

(75) Inventors: Jean-René Duguet; Jean-Pierre Vedel, both of Survilliers (FR)

(73) Assignee: Livbag SNC, Vert le Petit (FR)

( * ) Notice: Subject to any disclaimer, the term of this patent is extended or adjusted under 35 U.S.C. 154(b) by 0 days.

(21) Appl. No.: 09/413,474

(22) Filed: Oct. 6, 1999

(30) Foreign Application Priority Data

Oct. 6, 1998 (FR) ..... 98 12474

(51) Int. Cl.[7] ..... F42B 3/18; F42B 3/12; F42B 3/188

(52) U.S. Cl. ..... 102/202.2; 102/202.2; 102/202.4; 102/202.5; 102/200

(58) Field of Search ..... 102/202.2, 202.4, 102/202.7, 202.5, 200

(56) References Cited

U.S. PATENT DOCUMENTS

| | | | | |
|---|---|---|---|---|
| 3,306,202 | * | 2/1967 | Menichelli et al. | 102/202.2 |
| 3,572,247 | | 3/1971 | Warshall | 102/28 |
| 4,061,088 | | 12/1977 | Ueda | 102/28 R |
| 4,517,895 | | 5/1985 | Rucker | 102/202.2 |
| 4,592,280 | * | 6/1986 | Shores | 102/202.2 |
| 4,690,056 | | 9/1987 | Brede et al. | 102/202.2 |
| 4,959,011 | | 9/1990 | Nilsson | 431/263 |
| 5,099,762 | | 3/1992 | Drapala | 102/202.1 |
| 5,179,248 | | 1/1993 | Hartman et al. | 102/202.4 |
| 5,544,585 | | 8/1996 | Duguet | 102/202.5 |
| 5,596,163 | * | 1/1997 | Caflisch et al. | 102/202.2 |
| 5,616,881 | | 4/1997 | Hansen | 102/202.4 |
| 5,932,832 | * | 8/1999 | Hansen et al. | 102/202.4 |
| 5,942,717 | * | 8/1999 | Pathe et al. | 102/202.2 |
| 5,942,842 | * | 8/1999 | Fogie, Jr. | 313/313 |
| 6,007,096 | * | 12/1999 | Shirk et al. | 280/736 |

FOREIGN PATENT DOCUMENTS

| | | |
|---|---|---|
| 29 04 174 A1 | 8/1980 | (DE) . |
| 35 37 821 A1 | 4/1987 | (DE) . |
| 0 762 073 A1 | 3/1997 | (EP) . |
| 0 802 092 A1 | 10/1997 | (EP) . |
| 2 315 118 | 1/1998 | (GB) . |

* cited by examiner

*Primary Examiner*—Michael J. Carone
*Assistant Examiner*—Lulit Semunegus
(74) *Attorney, Agent, or Firm*—Pillsbury Winthrop LLP

(57) ABSTRACT

The electro-pyrotechnic initiation system preferably comprises an electro-pyrotechnic initiator (1) consisting especially of an insulating support (14) over which a flat resistive heating element (3) and two separate conductive metal areas (15, 16) are extended, the said resistive heating element and the said conductive metal areas being electrically connected to a current source (2) by means of two electrodes (9, 10). A conductive filter device (5), connected in parallel with the said resistive heating element (3), is divided into a varistor (6) and into a capacitor (7) which are connected to the electrodes (9, 10). This conductive filter device (5) has an equivalent resistance which varies depending on the measured electric potential difference between the two electrodes (9, 10) and ensures that the initiator (1) is not operated when the latter is subjected to a high-voltage electrostatic discharge.

This electro-pyrotechnic initiation system is more especially designed to be incorporated into a pyrotechnic gas generator or into a seat belt retractor used for motor-vehicle safety.

14 Claims, 3 Drawing Sheets

ELECTRO-PYROTECHNIC INITIATION SYSTEM PROTECTED AGAINST ELECTROSTATIC DISCHARGES

The present invention relates to the field of electro-pyrotechnic initiators intended for motor-vehicle safety and especially to the field of initiators intended for initiating seat belt retractors or pyrotechnic gas generators for air bags. The invention relates more particularly to initiators whose heating system consists of a resistive metal element connected to two thin layers of conductive metal.

Conventionally, electro-pyrotechnic initiators intended for motor-vehicle safety consist of an insulating body extended by a fragmentable metal cap, through which insulating body two electrodes pass. The electrodes are connected together by a resistive heating filament surrounded by an explosive ignition composition, for example a composition based on lead triresorcinate. Such initiators, which are for example described in U.S. Pat. No. 3,572,247; U.S. Pat. No. 4,517,895; U.S. Pat. No. 4,959,011; or U.S. Pat. No. 5,099,762, have the drawback, however, of being sensitive to the vibrations of the motor vehicle at the soldered joints between the resistive filaments and the electrodes. These soldered joints, when they are repeatedly stressed by the vibrations of the vehicle, can break and make the initiator inoperable.

In order to remedy this drawback, initiators have therefore been developed in which the electrodes are in contact with two separate conductive metal areas extended over the surface of the insulating body which is inside the metal cap. These two areas are connected together by a narrow flat resistive strip deposited on the surface of the insulating body. The conductive areas and the resistive strip are covered with an explosive ignition composition. Such initiators, which are for example described in U.S. Pat. No. 5,544,585 or U.S. Pat. No. 4,690,056, are no longer sensitive to the vibrations of the motor vehicle, but they have a new drawback. Because of the very small thickness of the conductive areas, often less than 50 micrometres, these initiators are sensitive to electrostatic discharges which may cause an undesirable triggering of the initiator or, at the very least, a serious deterioration of the state of these conductive areas. Attempts have been made to protect these initiators from this type of discharge, as described for example in U.S. Pat. No. 5,616,881 or EP 0,802,092, but these protective means are not always effective in the case of electrostatic discharges of very high voltage.

Those skilled in the art are therefore still confronted with the problem of having a reliable electro-pyrotechnic initiator which, when it is mounted in a gas generator or in a seat belt retractor with which a motor vehicle is fitted, is both insensitive to mechanical vibrations of the vehicle and insensitive to high-voltage electrostatic discharges which may be induced, for example, by a high-voltage electrical line.

The object of the present invention is specifically to propose such an initiator.

The invention therefore relates to an electro-pyrotechnic initiator comprising especially a resistive heating element which is covered by a pyrotechnic ignition composition and which is connected to two electrodes which can themselves be connected to an electric current source by means of an electrical connector, the said resistive heating element having a resistance of value Rc allowing ignition of the said ignition composition when the potential difference between the two electrodes reaches an operating value Uf, the said initiator being characterized in that the two electrodes are also connected together by a conductive filter device which is connected in parallel with the said resistive heating element, the equivalent resistance of the said conductive filter device having a value at least equal to 100Rc when the electric potential difference between the two electrodes is less than or equal to the operating voltage Uf, this equivalent resistance having a value of less than or equal to 0.25Rc when the potential difference between the two electrodes is greater than a predetermined value Uo greater than Uf.

Thus, by virtue of the presence in the initiator of a conductive filter device that can be modulated as a function of the voltage and is connected in parallel with the resistive heating element, when the voltage applied to the electrodes is the operating voltage the current will pass via the resistive heating element and will cause the initiator to operate. On the other hand, should the voltage be greater than the predetermined threshold value Uo and be due to an electrostatic discharge, the current will pass through the conductive filter device, the equivalent resistance of which will have dropped and will provide the resistive heating element. Finally, it should be noted that in the event of electrostatic discharge with a voltage less than the predetermined threshold value Uo, there is no risk of degradation of the initiator since, in this situation, the energy which is delivered to it is too low.

According to a first embodiment of the invention, the conductive filter device consists of a capacitor and a varistor which are connected in parallel with each other. In this arrangement, the capacitor reinforces the effectiveness of the varistor in the event of very high overvoltage.

Preferably, the resistive heating element will consist of a thin flat resistive element deposited on an insulating printed-circuit support and connected to the two electrodes via two separate conductive metal areas extended over the said support, each area being in contact with one of the two electrodes.

The resistive heating element may be based on a nickel-chromium alloy, the conductive areas will generally be based on copper and the support will be made of ceramic, glass or based on a glass/resin mixture, the resin being, for example, an epoxy resin.

Advantageously, the varistor will consist of assemblies of thin semiconductor layers, for example layers based on tantalum or on germanium, which will be attached to the said conductive areas.

Also advantageously, the capacitor will consist of assemblies of thin layers that are alternately conductive and insulating and are attached to the said conductive areas.

According to a second embodiment of the invention, the said conductive filter device consists of two Zener diodes, the threshold voltage of which is equal to the predetermined value Uo, which Zener diodes are connected in parallel with each other and with opposed conducting directions, in other words they are connected in parallel "head to tail".

Preferably, the resistive heating element will consist of a thin flat resistive element deposited on an insulating printed-circuit support and connected to the two electrodes via two separate conductive metal areas extended over the said support, each area being in contact with one of the two electrodes.

The resistive heating element may be based on a nickel-chromium alloy, the conductive areas will generally be based on copper and the support will be made of ceramic, glass or based on a glass/resin mixture, the resin being, for example, an epoxy resin.

Also advantageously, the said Zener diodes will consist of assemblies of thin semiconductor layers, for example layers based on tantalum or on germanium, these layers being attached to the said conductive areas.

In order to further increase the operating reliability of the initiators according to the invention, a filter coil will advantageously be connected in series with one of the electrodes so as to clip the overvoltage peak.

This coil may be mounted in the initiator itself or else in the connector connected to the electrodes of the initiator.

The invention therefore also relates to the use of an initiator as described above, by connecting the electrodes of this initiator to a connector having two electrical conductors, characterized in that one of the conductors, for example a tubular socket, is connected in series with a filter coil.

The invention thus makes it possible, in its preferred embodiments, to have particularly reliable electro-pyrotechnic initiators which are insensitive to mechanical vibrations and to overvoltages due to undesirable electrostatic discharges. The preferred application of these initiators is as initiators for seat belt retractors or as initiators for pyrotechnic gas generators intended for inflating air bags for the occupants of a motor vehicle.

In addition, it is possible to generalize the invention to an electro-pyrotechnic initiation system comprising especially an electro-pyrotechnic initiator and an electrical connection means, the said electro-pyrotechnic initiator containing a resistive heating element which is covered by a pyrotechnic ignition composition and which is connected to two electrodes which are themselves connected to an electric current source by means of the said electrical connection means, the said resistive heating element having a resistance of value Rc allowing ignition of the said ignition composition when the electric potential difference between the electrodes reaches an operating value Uf, the said initiation system being characterized in that it contains a conductive filter device which is connected in parallel with the resistive heating element, the equivalent resistance of the said conductive filter device having a value at least equal to 100Rc when the measured potential difference in the electrical connection means is less than or equal to the operating voltage Uf, this equivalent resistance having a value of less than or equal to 0.25Rc when the measured electric potential difference in the electrical connection means is greater than a predetermined value Uo greater than Uf.

According to a preferred embodiment of the invention, the electrical connection means consists of an electrical connector. The latter has two electrical conductors, for example two tubular sockets, which are each connected to one of the two electrodes of the initiator.

According to another preferred embodiment, the conductive filter device is incorporated in the electrical connector. If the two electrical conductors of the electrical connector consist of two tubular sockets, the latter will be connected together by the conductive filter device which itself will be connected in parallel with the resistive heating element.

Advantageously, the conductive filter device consists either of a capacitor and a varistor which are connected in parallel with each other or of two Zener diodes, the threshold voltage of which is equal to the predetermined value Uo, these being connected in parallel with each other and with opposed conducting directions.

A preferred embodiment of the invention is described below with reference to FIGS. 1 to 4.

Figure 3:
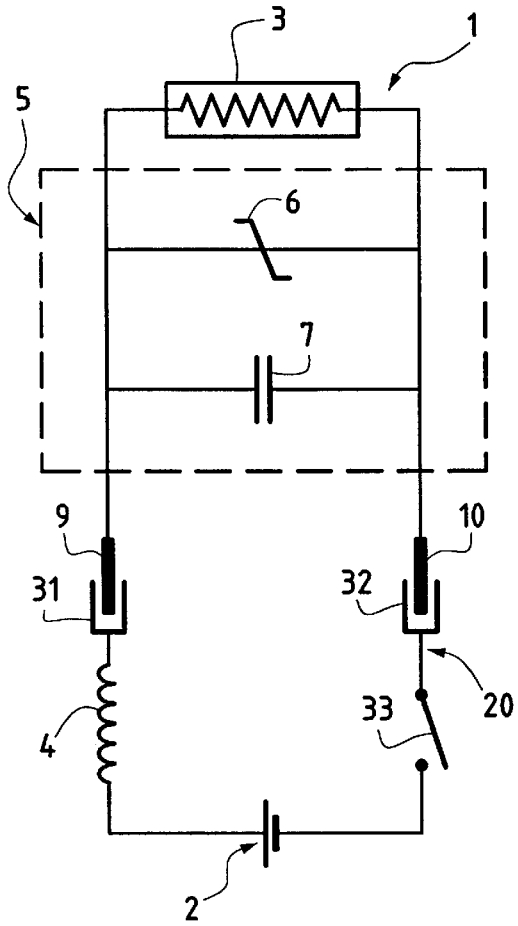
FIG. 3 is a circuit diagram of the initiator illustrated in FIGS. 1 and 2, when it is connected to a connector incorporating a filter coil.

Referring to FIG. 3, which illustrates the circuit diagram of an electro-pyrotechnic initiator 1 according to the first embodiment of the invention when it is connected to an electrical connector 20, it may be seen that a resistive heating element 3 having a resistance of value Rc is electrically connected to the said connector 20 via two electrodes 9, 10 and two tubular sockets 31, 32. More specifically, the electrode 9 of the initiator 1 is inserted into the tubular socket 31 of the connector 20 and the electrode 10 of the initiator 1 is inserted into the tubular socket 32 of the said connector 20. The latter is connected to a current source 2 and to a suitable switch 33 and contains a filter coil 4. A conductive filter device 5, which is connected in parallel with the resistive heating element 3, is more specifically divided into a varistor 6 and into a capacitor 7, these being connected in parallel with each other.

Figure 1:
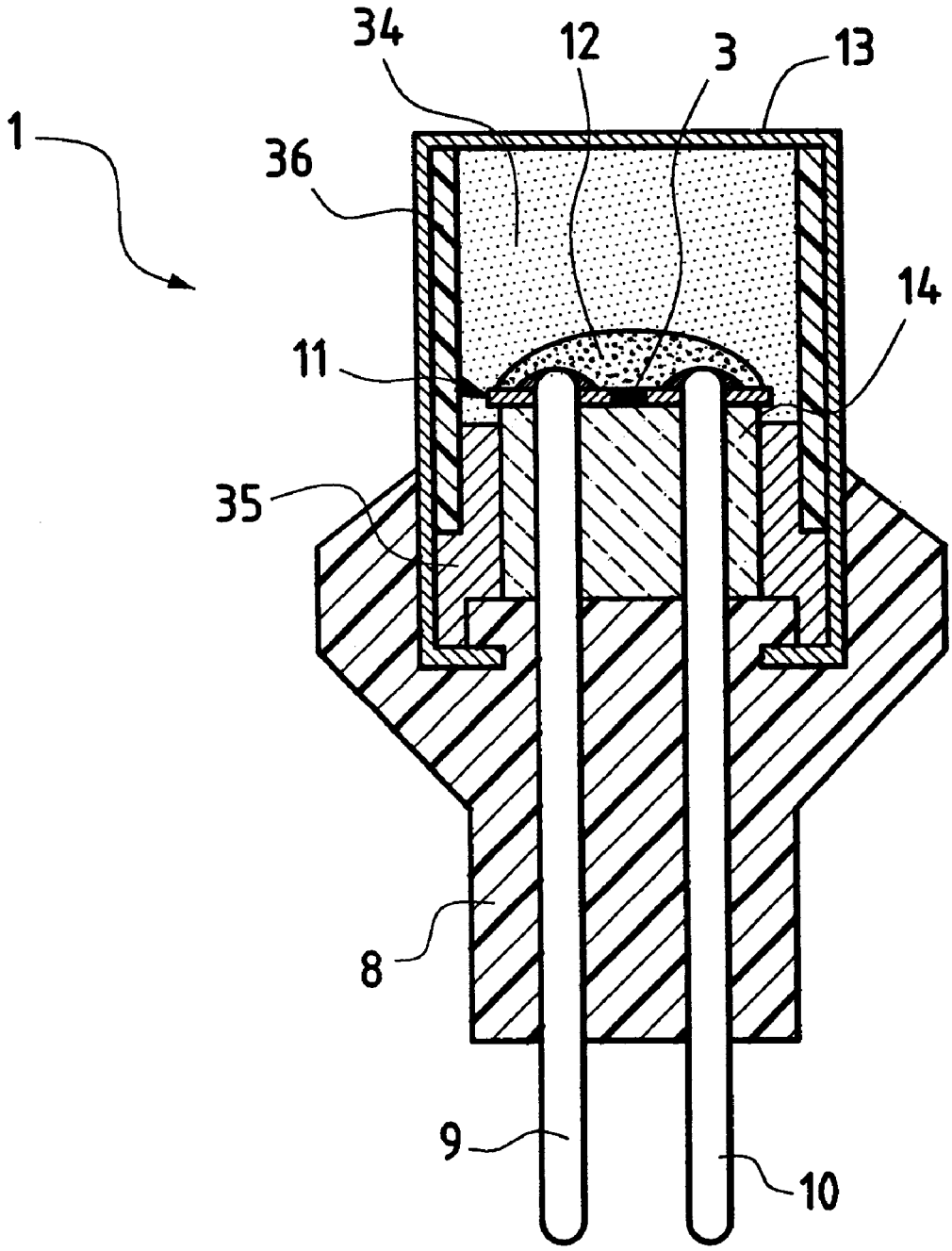
FIG. 1 illustrates, in sectional view, an initiator according to the invention in which the conductive filter device consists of a capacitor and of a varistor (these not being illustrated).

Referring more particularly to FIG. 1, it may be seen that this electro-pyrotechnic initiator 1 is made from an insulating printed-circuit support 14 consisting of a discoid plate based on a glass/resin mixture, the resin being, for example, an epoxy resin, through which insulating support the two electrodes 9, 10 pass. Each of these two electrodes 9, 10 has, on the one hand, an upper end fixed by soldering to an ignition plate 11 which is itself attached to the insulating support 14 and, on the other hand, a lower end intended to be connected to the corresponding tubular socket 31, 32. A pyrotechnic ignition composition 12 is deposited on the ignition plate 11 and is surmounted by a fragmentable metal cap 13 containing a reinforcing pyrotechnic composition 34, this fragmentable metal cap 13 being crimped onto a cylindrical metal sleeve 35 which grips the insulating support 14. An overmoulding 8 of thermoplastic resin partially encapsulates the electrodes 9, 10 and, together with the fragmentable metal cap 13, ensures that the initiator 1 is sealed.

In the embodiment illustrated in FIG. 1, it may be seen that a plastic skirt 36 insulates the reinforcing pyrotechnic composition 34 from the fragmentable metal cap 13.

Figure 2:
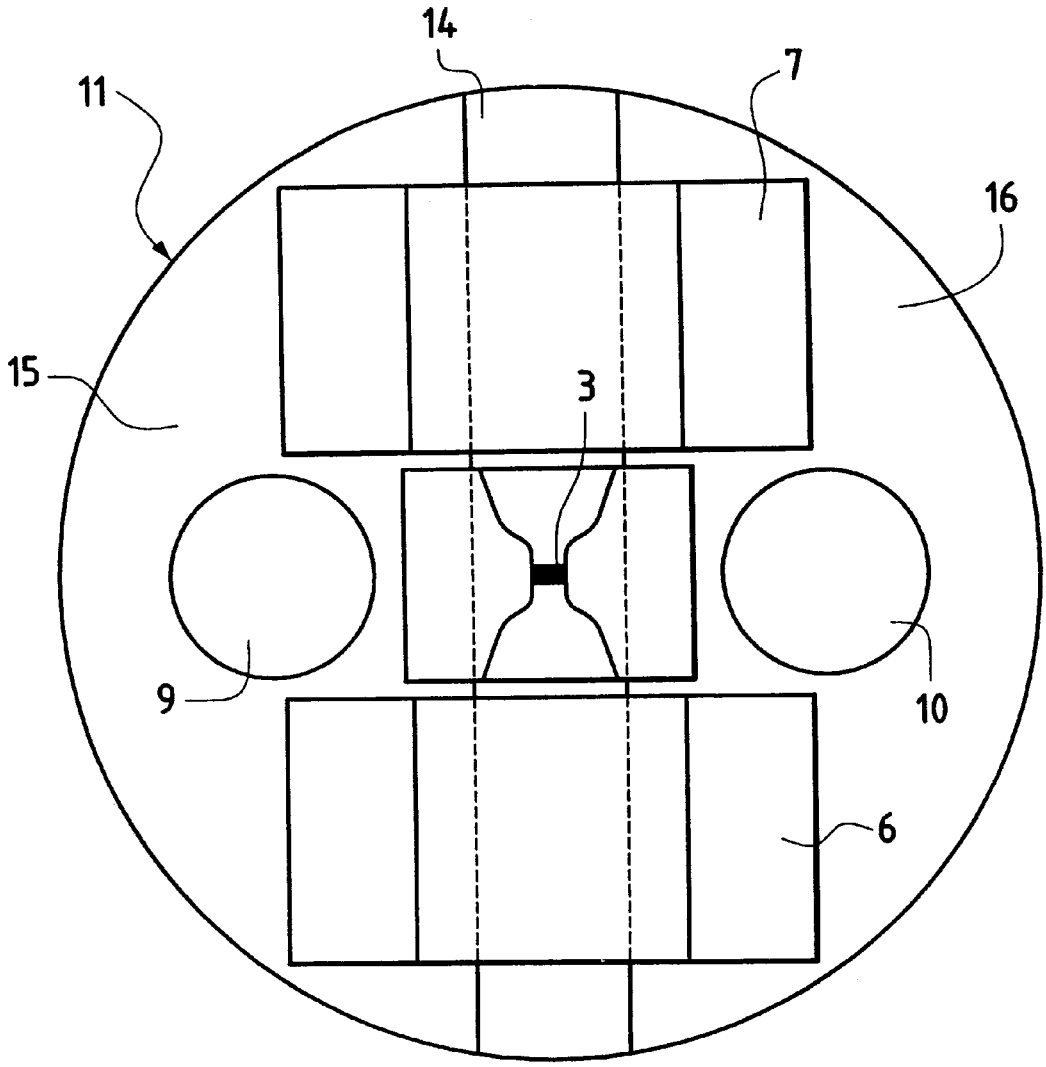
FIG. 2 is a top view of the insulating support of the initiator illustrated in FIG. 1.

Referring to FIG. 2, it may be seen that the ignition plate 11, according to a preferred embodiment, consists more particularly of two conductive metal areas 15, 16 connected together by the resistive heating element 3 and by the varistor 6 and the capacitor 7.

More specifically, the resistive heating element 3 is made using a flat resistive element, for example based on a nickel-chromium alloy, the thickness of which is between 0.001 mm and 0.01 mm and the surface of which, which is bare and directly in contact with the pyrotechnic ignition composition 12, has an area of between 0.01 $mm^2$ and 0.2 $mm^2$. This resistive heating element 3 is in contact both with the conductive area 15 and the conductive area 16, these areas each being formed from a layer of copper in the form of a circular segment approximately 35 micrometres in thickness. The conductive area 15 is connected to the electrode 9 and the conductive area 16 is connected to the electrode 10 so as to ensure electrical linkage between the resistive heating element 3 and the two electrodes 9 and 10. The varistor 6 consists of assemblies of thin semiconductor layers which are attached to the said conductive areas 15, 16 and the capacitor 7 consists of assemblies of thin layers that are alternately conductive and insulating and are also attached to the conductive areas 15, 16. The various thin layers used for producing the varistor 6 are advantageously based on tantalum or germanium.

This conductive filter device 5 composed of the varistor 6 and of the capacitor 7 has, on the one hand, an equivalent resistance having a value equal to 100Rc when the electric potential difference between the two electrodes 9, 10 is less than or equal to a voltage Uf, called the operating voltage, and, on the other hand, an equivalent resistance having a value equal to 0.25Rc when the potential difference between the two electrodes 9, 10 is greater than a predetermined threshold value Uo which is itself greater than the operating voltage Uf.

When it proves to be desirable and necessary to initiate this electro-pyrotechnic initiator 1, the current source 2 which is connected to this initiator 1 by closing the switch 33 is activated and the measured electric potential difference between the electrodes 9, 10 is then equal to the operating voltage Uf for a period of time of the order of a few milliseconds. The thermal energy released by the resistor of value Rc of the resistive heating element 3 is then sufficient to ignite the ignition composition 12 and consequently to burst the metal cap 13.

On the other hand, in the situation in which the electro-pyrotechnic initiator 1 is subjected to a high-voltage electrostatic discharge, in any case greater than the predetermined threshold value Uo, the conductive filter device 5 prevents undesirable initiation of the said initiator 1. This is because, as the conductive filter device 5 is connected in parallel with the resistive heating element 3 and the value of the equivalent resistance of the conductive filter device 5 then drops to a value of 0.25Rc, since the voltage is greater than the predetermined value Uo, a low-intensity current passes through the resistive heating element 3, this current not producing thermal energy sufficient to ignite the ignition composition 12. Since the varistor 6 may malfunction when the voltage reaches very high values, the drop in the value of the equivalent resistance, by virtue of which the resistive heating element 3 is provided, is then provided by the capacitor 7.

Finally, if the electro-pyrotechnic initiator 1 is subjected to an electrostatic discharge of a duration of the order of a few nanoseconds and the voltage of which has a value of between the value of the operating voltage Uf and the predetermined threshold value Uo, the thermal energy released by the resistive heating element 3 is insufficient to cause undesirable initiation of the ignition composition 12.

The filter coil 4, which is incorporated here in the connector 20, but which could be connected in series with one of the two electrodes 9, 10, makes it possible to clip the overvoltage peaks.

Figure 4:
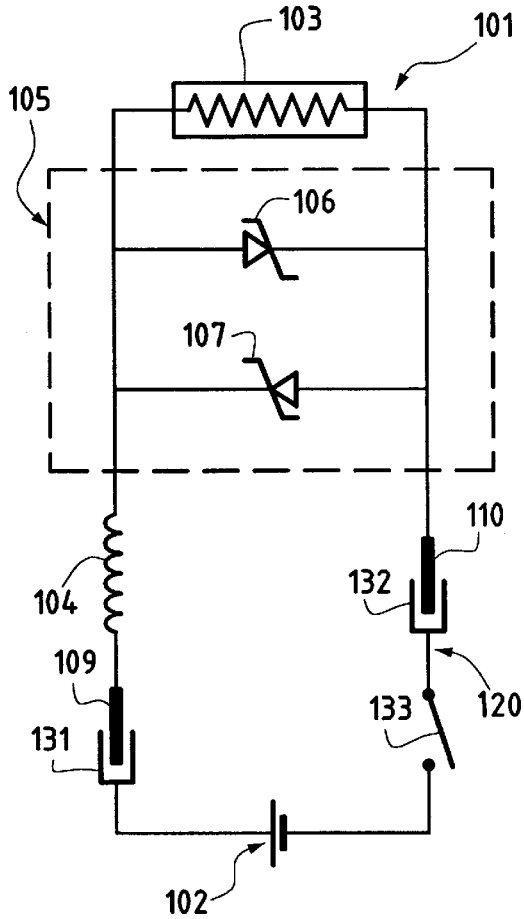
FIG. 4 is a circuit diagram of an initiator in which the conductive filter device consists of two Zener diodes, this initiator being connected to a connector and comprising a filter coil connected in series with one of its electrodes.

Referring to FIG. 4, which illustrates the circuit diagram of an electro-pyrotechnic initiator 101 according to the second embodiment of the invention, when it is connected to an electrical connector 120, it may be seen that a resistive heating element 103 having a resistance of value Rc is electrically connected to the said connector 120 via two electrodes 109, 110 and two tubular sockets 131, 132. More specifically, the electrode 109 of the initiator 101 is inserted into the tubular socket 131 of the connector 120 and the electrode 110 of the initiator 101 is inserted into the tubular socket 132 of the connector 120. The latter is connected to a current source 102 and to a suitable switch 133. A filter coil 104 is connected in series with the electrode 109 of the initiator 101. A conductive filter device 105, which is connected in parallel with the resistive heating element 103, is divided into two Zener diodes 106, 107 connected in parallel with each other and with opposed conducting directions.

In addition, the equivalent resistance of the conductive filter device 105, consisting of the said Zener diodes 106, 107, has a value equal to 100Rc when the voltage to which the resistive heating element 103 is subjected is less than or equal to a so-called operating voltage Uf, this equivalent resistance having a value equal to 0.25Rc when the voltage to which the resistive heating element 103 is subjected is greater than the predetermined threshold value Uo which is itself greater than the operating voltage Uf. The two Zener diodes 106, 107 are therefore turned on only when the voltage to which they are subjected is greater than or equal to the predetermined value Uo.

As previously, when it proves to be desirable and necessary to initiate this electro-pyrotechnic initiator 101, the current source 102 connected to the said initiator 101 is activated and the resistive heating element 103 is then subjected to the operating voltage Uf for a period of time of a few milliseconds. The energy released by the latter thus ignites the ignition composition which is in contact with the resistive heating element 103.

On the other hand, in the situation in which the electro-pyrotechnic initiator 101 is subjected to an electrostatic discharge having a voltage greater than the predetermined threshold value Uo, the two Zener diodes 106, 107 prevent undesirable initiation of the said initiator 101. This is because, since the value of the equivalent resistance of the two Zener diodes 106, 107 then drops to a value of 0.25Rc and the said Zener diodes 106, 107 are connected in parallel with the resistive heating element 103, a low-intensity current passes through this resistive heating element 103, this current not producing thermal energy sufficient to ignite the ignition composition.

Finally, when the electro-pyrotechnic initiator 101 is subjected to an electrostatic discharge having a duration of the order of a few nanoseconds and the voltage of which has a value of between the value of the operating voltage Uf and the predetermined threshold value Uo, the two Zener diodes 106, 107 are not turned on but the thermal energy released by the resistive heating element 103 is insufficient to cause undesirable initiation of the ignition composition.

The filter coil 104, which is connected here in series with the electrode 109 of the initiator 101, makes it possible to clip the overvoltage peaks.

What is claimed is:

1. Electro-pyrotechnic initiator (1, 101) comprising especially a resistive heating element (3, 103) which is covered by a pyrotechnic ignition composition (12) and which is connected to two electrodes (9, 10, 109, 110) which can themselves be connected to an electric current source (2, 102) by means of an electrical connector (20, 120), the said resistive heating element (3, 103) having a resistance of value Rc allowing ignition of the said ignition composition (12) when the potential difference between the electrodes (9, 10, 109, 110) reaches an operating value Uf, characterized in that, the two electrodes (9, 10, 109, 110) are also connected together by a conductive filter device (5, 105) which is connected in parallel with the said resistive heating element (3, 103), the equivalent resistance of the said conductive filter device (5, 105) having a value at least equal to 100Rc when the electric potential difference between the two electrodes (9, 10, 109, 110) is less than or equal to the operating voltage Uf, this equivalent resistance having a value of less than or equal to 0.25Rc when the potential difference between the electrodes (9, 10, 109, 110) is greater than a predetermined value Uo greater than Uf.

2. Initiator according to claim 1, characterized in that the said conductive filter device (5) consists of a capacitor (7) and a varistor (6) which are connected in parallel with each other.

3. Initiator according to claim 2, characterized in that the resistive heating element (3) consists of a thin flat resistive element deposited on an insulating printed-circuit support (14) and connected to the two electrodes (9, 10) via two separate conductive metal areas (15, 16) extended over the said support (14), each area being in contact with one of the two electrodes.

4. Initiator according to claim 3, characterized in that the varistor (6) consists of assemblies of thin semiconductor layers attached to the said conductive areas (15, 16).

5. Initiator according to claim 3, characterized in that the capacitor (7) consists of assemblies of thin layers that are alternately conductive and insulating and are attached to the said conductive areas (15, 16).

6. Initiator according to claim 1, characterized in that the said conductive filter device (105) consists of two Zener diodes (106, 107), the threshold voltage of which is equal to the predetermined value Uo, which Zener diodes are connected in parallel with each other and with opposed conducting directions.

7. Initiator according to claim 6, characterized in that the resistive heating element (103) consists of a thin flat resistive element deposited on an insulated printed-circuit support and connected to the two electrodes (109, 110) via two separate conductive metal areas extended over the said support, each area being in contact with one of the two electrodes.

8. Initiator according to claim 7, characterized in that the said Zener diodes (106, 107) consist of assemblies of thin semiconductor layers attached to the said conductive aeras.

9. Initiator according to any one of claims 1 to 8, characterized in that a filter coil (104) is connected in series with one of the electrodes.

10. Use of an initiator according to any one of claims 1 to 8 by connecting the said electrodes to a connector having two electrical conductors, characterized in that one of the conductors is connected in series with a filter coil (4).

11. Electro-pyrotechnic initiation system comprising especially an electro-pyrotechnic initiator (1, 101) and an electrical connection means, the said electro-pyrotechnic initiator (1, 101) containing a resistive heating element (3, 103) which is covered by a pyrotechnic ignition composition (12) and which is connected to two electrodes (9, 10, 109, 110) which are themselves connected to an electric current source (2, 102) by means of the said electrical connection means, the said resistive heating element (3, 103) having a resistance of value Rc allowing ignition of the said ignition composition (12) when the electric potential difference between the electrodes (9, 10, 109, 110) reaches an operating value Uf, characterized in that, the initiation system contains a conductive filter device (5, 105) which is connected in parallel with the resistive heating element (3, 103), the equivalent resistance of the said conductive filter device (5, 105) having a value at least equal to 100Rc when the measured potential difference in the electrical connection means is less than or equal to the operating voltage Uf, this equivalent resistance having a value of less than or equal to 0.25Rc when the measured electric potential difference in the electrical connection means is greater than a predetermined value Uo greater than Uf.

12. Initiation system according to claim 11, characterized in that said electrical connection means consists of an electrical connector (20, 120).

13. Initiation system according to claim 12, characterized in that the conductive filter device consists of a capacitor and a varistor which are connected in parallel with each other.

14. Initiation system according to claim 12, characterized in that the conductive filter device consists of two Zener diodes, the threshold voltage of which is equal to the predetermined value Uo, which Zener diodes are connected in parallel with each other and with opposed conducting directions.

* * * * *